US006296022B1

(12) United States Patent
Lowe

(10) Patent No.: US 6,296,022 B1
(45) Date of Patent: Oct. 2, 2001

(54) WOVEN FABRIC WITH MACHINE-READABLE CODE

(75) Inventor: John Charles Lowe, Coventry (GB)

(73) Assignee: J&J Cash Limited, Coventry (GB)

( * ) Notice: Subject to any disclaimer, the term of this patent is extended or adjusted under 35 U.S.C. 154(b) by 0 days.

(21) Appl. No.: 09/540,853

(22) Filed: Mar. 31, 2000

(30) Foreign Application Priority Data

Sep. 18, 1999 (GB) ..... 9922025

(51) Int. Cl.[7] ..... D03D 25/00

(52) U.S. Cl. ..... 139/383 R; 139/1 R; 139/383 R; 139/417

(58) Field of Search ..... 139/1 R, 11, 59, 139/383 R, 417

(56) References Cited

U.S. PATENT DOCUMENTS 4,766,301 * 8/1988 Evers ..... 235/487
5,845,148 * 12/1998 Ichikawa et al. ..... 710/8

FOREIGN PATENT DOCUMENTS

0076405 * 4/1983 (EP) ..... D03D/11/02
2337724 * 12/1999 (GB) ..... D03D/1/00

* cited by examiner

*Primary Examiner*—John J. Calvert
*Assistant Examiner*—Robert H. Muromoto, Jr.
(74) *Attorney, Agent, or Firm*—Hagen Law Firm PLLP

(57) ABSTRACT

A woven fabric, in particular a label, having a region formed from a ground weave which defines a background, with the region including an array of spaced apart dots formed by yarns exposed on the surface of the ground weave, and with the array of spaced apart dots collectively defining a machine-readable code.

11 Claims, 1 Drawing Sheet

WOVEN FABRIC WITH MACHINE-READABLE CODE

The present invention relates to a woven fabric, in particular but not exclusively a woven label, incorporating a woven in machine-readable code.

The present invention also relates to a process for producing woven fabric, in particular labels, incorporating a woven in machine-readable code.

According to one aspect of the present invention there is provided a woven fabric, in particular a label, having a region formed from a ground weave which defines a background, said region including an array of spaced apart dots formed by yarns exposed on the surface of the ground weave, said array of spaced apart dots collectively defining a machine-readable code.

Preferably the dots are defined by weft yarns which contrast with the background defined by the ground weave.

In a first embodiment, the dots are spaced apart in both the warp and weft directions to define a two dimensional machine-readable code. Preferably for the first embodiment each dot is of the same size and is defined by a predetermined number of adjacent wefts which float over a predetermined number of adjacent warps to define a dot of a predetermined shape. Preferably said predetermined shape of each dot is generally square.

As an example the square shape of each dot is formed by two adjacent wefts extending across three adjacent warps.

Preferably for the first embodiment the array of dots is arranged in a predetermined number of rows and columns, the spacing between adjacent rows being preferably 2 wefts and the spacing between adjacent columns being preferably 3 warps.

In a second embodiment the dots are spaced in the weft direction only to define warp extending columns spaced apart in the weft direction and thereby define a one dimensional machine-readable code, commonly referred to as a bar code.

For the second embodiment the dots in each column are formed by dot forming weft yarns floating over the same number of warps in order to produce a bar of a desired width extending in the warp direction.

For both embodiments, the dot forming yarn from which the dots are formed is chosen to provide a contrast with the ground weave such that a machine is able to detect the presence of the dots on the surface of the ground weave. Accordingly the yarn for forming the dots may be of any type which achieves this function.

For example the dot forming yam may be of a colour which contrasts with the colour of the ground weave. With such an arrangement the array of dots is visible on the surface of the ground weave.

Alternatively, the dot forming yarn may be invisible under normal white light but is detectable under a different light, eg. ultraviolet light. With such an arrangement the array of dots would be not be visible on the surface of the ground weave under normal white light conditions.

According to another aspect of the present invention there is provided a process for producing woven fabric, in particular labels, the process comprising weaving a ground weave from weft and warp yarns, and at a predetermined region of the fabric selectively introducing dot forming yarns to create an array of dots on the surface of said ground weave to define a machine-readable code.

Preferably the fabric is woven on a loom having a jacquard for controlling shedding of warp yarns and preferably at least in said region the jacquard is arranged to selectively control shedding of individual warp yarns.

Preferably the jacquard is electronically controlled by a computer which is programmed to provide the pattern information for generating the desired array of dots in said region. The computer may be arranged to provide the same array of dots for each successively woven region or may be arranged to provide a different array of dots for each successively woven region.

The loom may be a narrow fabric loom or a broadloom.

When producing labels, it is envisaged that a ribbon of successive labels will be produced and that more than one ribbon may be simultaneously produced across the width of the loom. The individual ribbons may be woven separately side by side, for example on a twin rapier needle loom, or may be joined whilst being woven to form a sheet and then subsequently separated, for example by slitting.

When producing more than one ribbon of labels simultaneously, it is envisaged that the jacquard may be controlled so as to weave the same or different arrays of dots in said regions which are being simultaneously woven across the loom.

Various aspects of the present invention are hereinafter described with reference to the accompanying drawings in which.

Figure 1:
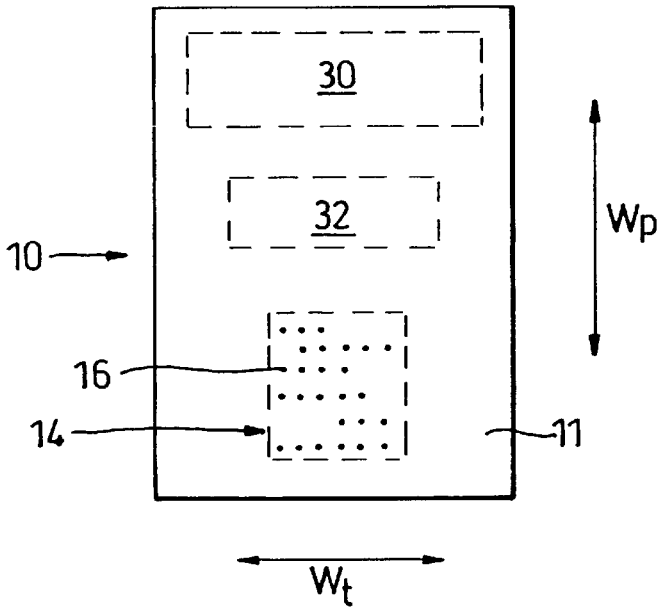
FIG. 1 is a plan view of a label according to an embodiment of the present invention.

Referring to FIG. 1 there is shown a label 10 according to an embodiment of the present invention. The label is of a woven construction, the warp direction being shown as Wp and the weft direction being shown as Wt.

The body 11 of the label 10 is formed by a ground weave and within the body 11 there is provided a machine readable code region 14 which is defined by an array of dots 16.

The body 11 of the label 10 is formed by a ground weave which produces a surface appearance which is suitable for reading by an optical scanner.

Preferably such a weave is a tight weave which provides a consistent background for the scanner; the choice of yarns and/or weave preferably being such as to provide a dull or matt appearance. Accordingly, textured yarns are preferably used for both the warp and weft. Also, the weave structure is preferably a plain weave, such as for example taffeta.

Figure 2:
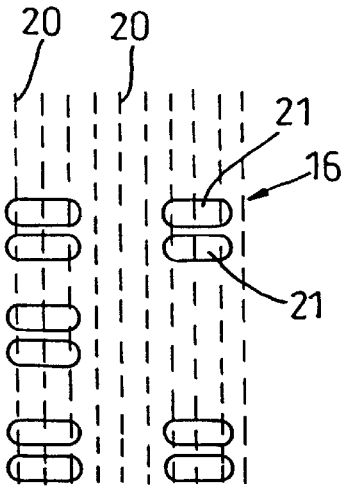
FIG. 2 is a diagrammatic view of a weave showing part of an array of dots which form a two dimensional machine-readable code.

As more clearly seen in FIG. 2, in a first embodiment the dots 16 are defined by dot forming weft yarn which is floated across adjacent warps 20 (shown as broken lines) to define a float 21 lying on the surface of the ground weave.

In FIG. 2 each dot 16 is formed from one or more adjacent floats 21 in order to define a dot of a shape and size which is capable of being machine read. Preferably each dot 16 is generally square in shape and is preferably defined by two adjacent floats 21 which extend across three adjacent warps 20.

As shown in FIG. 2, for defining a two dimensional machine readable code the dots 16 are spaced apart in both the warp Wp and weft Wt directions to reside in spaced apart columns and spaced apart rows. For defining a two dimensional machine-readable code, the dots 16 are preferably of the same size and shape.

Figure 3:
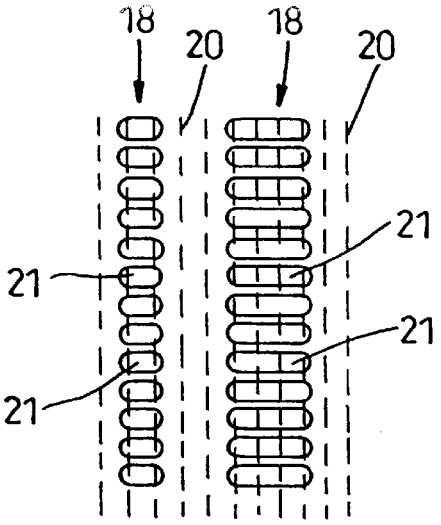
FIG. 3 is a diagrammatic view of a weave showing part of any array of dots which form a one dimensional machine-readable code.

As shown in FIG. 3, for defining a one dimensional machine-readable code the dots 16 are spaced in the weft direction and arranged in spaced apart columns only. The columns extend in the warp direction Wp and define spaced apart bars 18. The dots 16 in each column are formed from floats 21 which float across the same number of adjacent warps in order to provide a bar of the desired width. Adjacent bars are spaced apart in the weft direction Wt by a desired number of adjacent warps 20. The floats 21 are formed in successive weft insertions such that all floats 21 in each are closely spaced from their neighbouring features.

The size of each dot 16 is chosen to provide a size which is suitable for reading by an optical scanner. Accordingly each dot 16 may be formed by any suitable number of weft yarns extending over any suitable number of warp yarns. In an extreme example, in order to produce a very small dot, it is envisaged that the dot 16 may be formed by a single weft extending over a single warp.

An example of a label incorporating dots 16 of approximately 0.5 mm square is given below.

EXAMPLE

A dearly defined dot of approximate size 0.5 mm square can be achieved using the following combination of warp and weft yarns.

| Weave Structure | Taffeta |
|---|---|
| Number of warps | 3 |
| Warp yarn | 110 dtex textured polyester |
| Warp Yarn Density | 6 threads/mm |
| Number of wefts | 2 |
| Weft yarn | 110 dtex textured poiyester |
| Weft Yarn Density | 3 threads/mm |

The body 11 of label 10 may include other information carrying regions. For example the label 10 is shown including a generic information region 30 which carries the same information on different labels. For example, the generic region 30 may contain a manufacturers name and/or logo. Label 10 is also shown having a specific information carrying region 32 which carries different information on different labels. For example, the labels may be used to identify a garment size or garments belonging to individual employees in a company and region 32 carries the size or the name of a specific employee.

Preferably, labels 10 are produced on a narrow fabric loom or a broadloom. having an electronically controlled jacquard. The loom includes weft yarn selection to enable different weft yarns to be selectively inserted into the weave when required.

The labels may be produced on a narrow fabric loom as one or more discrete ribbons each comprising a string of labels having selvedges.

Figure 4:
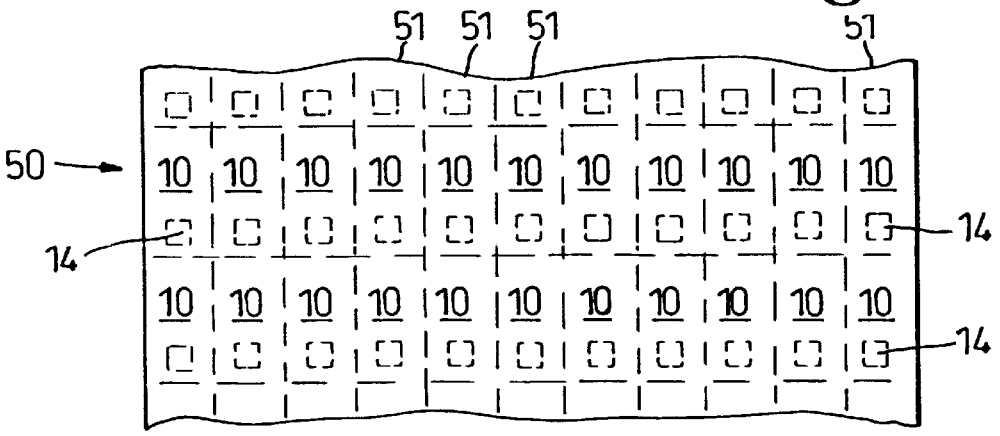
FIG. 4 is a schematic view of part of a sheet of woven fabric containing a plurality of side by side ribbons of labels according to an embodiment of the present invention.

Alternatively, as seen in FIG. 4 the labels may be produced on a narrow fabric loom or a broadloom in a sheet so comprising joined ribbons 51 of labels which are subsequently slit into discrete ribbons.

The jacquard is preferably arranged to control individual warps at least for those warps passing through regions 14 and where provided, regions 32. This enables the jacquard to control shedding of the warps in these regions for providing unique information in region 14 (and region 32, if provided) for labels being woven simultaneously across the width of the loom.

Preferably the ground weave defines a background that gives a strong contrast against the yarn forming the dot.

It is envisaged that other dot forming yarns may be used which are invisible in white light but contrast with the background weave under different light, eg ultraviolet light. A suitable yarn would perhaps have fluorescent properties.

In the above example, the weft is floated across adjacent warps in order to define a dot 16. It is envisaged that as an alternative, the warp may be floated across adjacent wefts in order to define a dot 16.

What is claimed is:

1. A woven fabric label having a body member with a machine-readable code region formed thereon aid comprising a ground weave which defines a background, said code region consisting of an array of spaced apart dots formed by yarns exposed at selected distinct and spaced apart locations on the surface of the said ground weave defining a plurality of straight line patterns, with said array of spaced apart dots collectively defining a machine-readable code.

2. A woven fabric label according to claim 1 wherein the dots are spaced apart in both the warp and weft directions to define a two dimensional machine-readable code.

3. A woven fabric label according to claim 2 wherein each dot is of the same size.

4. A woven fabric label according to claim 3 wherein each dot is defined by a predetermined number of adjacent wefts which float over a predetermined number of adjacent warps to define a dot of a predetermined shape.

5. A woven fabric label according to claim 4 wherein said predetermined shape is square.

6. A woven fabric label according to any of claims 2 to 5 wherein the array of dots is arranged in alignment and along a predetermined number of rows and columns.

7. A woven fabric label according to claim 1 wherein the dots are spaced in the weft direction only to define warp extending columns spaced apart in the weft direction and thereby define a one dimensional machine-readable code.

8. A process for producing woven fabric labels having a machine-readable code woven therewithin, the process comprising weaving a ground weave fabric body member from weft and warp yarns, and at a predetermined region within the fabric body member selectively introducing dot forming yarns at distinct and spaced apart locations to create an array of dots on the surface of said ground weave to define a plurality of straight line patterns forming a machine-readable code.

9. A process according to claim 8 wherein the fabric body member is woven on a loom having a jacquard for controlling shedding of warp yarns, with the jacquard being arranged to selectively control shedding of individual warp yarns.

10. A process according to claim 9 wherein the jacquard is electronically controlled by a computer to provide the pattern information for generating the desired array of dots in said region, the computer being arranged to provide the same array of dots for each successively woven region or being arranged to provide a different array of dots for each successively woven region.

11. A process according to claim 9 or 10 wherein a plurality of ribbons of successive labels are ultaneously produced, the jacquard being controlled to weave the same or different arrays of dots in said regions which are being simultaneously woven across said jacquard equipped loom.

* * * * *

UNITED STATES PATENT AND TRADEMARK OFFICE

CERTIFICATE OF CORRECTION

PATENT NO. : 6,296,022 B1
DATED : October 2, 2001
INVENTOR(S) : John Charles Lowe It is certified that error appears in the above-identified patent and that said Letters Patent is hereby corrected as shown below:

Column 4,
Line 12, "aid" should read -- and --.
Line 60, "ultaneously" should read -- simultaneously --.

Signed and Sealed this

Ninth Day of April, 2002

*Attest:*

*Attesting Officer*

JAMES E. ROGAN
*Director of the United States Patent and Trademark Office*

US006296022C1

(12) EX PARTE REEXAMINATION CERTIFICATE (9499th)

United States Patent
Lowe

(10) Number: US 6,296,022 C1
(45) Certificate Issued: Jan. 29, 2013

(54) WOVEN FABRIC WITH MACHINE-READABLE CODE

(75) Inventor: John Charles Lowe, Coventry (GB)

(73) Assignee: J & J Cash Limited, Coventry (GB)

Reexamination Request:
No. 90/012,199, Mar. 16, 2012

Reexamination Certificate for:

| | |
|---|---|
| Patent No.: | **6,296,022** |
| Issued: | **Oct. 2, 2001** |
| Appl. No.: | **09/540,853** |
| Filed: | **Mar. 31, 2000** |

Certificate of Correction issued Apr. 9, 2002.

(51) Int. Cl.
*D03D 1/00* (2006.01)

(52) U.S. Cl. ..... 139/383 R; 139/1 R; 139/417

(58) Field of Classification Search ..... None
See application file for complete search history.

(56) References Cited

To view the complete listing of prior art documents cited during the proceeding for Reexamination Control Number 90/012,199, please refer to the USPTO's public Patent Application Information Retrieval (PAIR) system under the Display References tab.

*Primary Examiner* — Robert M. Fetsuga

(57) ABSTRACT

A woven fabric, in particular a label, having a region formed from a ground weave which defines a background, with the region including an array of spaced apart dots formed by yarns exposed on the surface of the ground weave, and with the array of spaced apart dots collectively defining a machine-readable code.

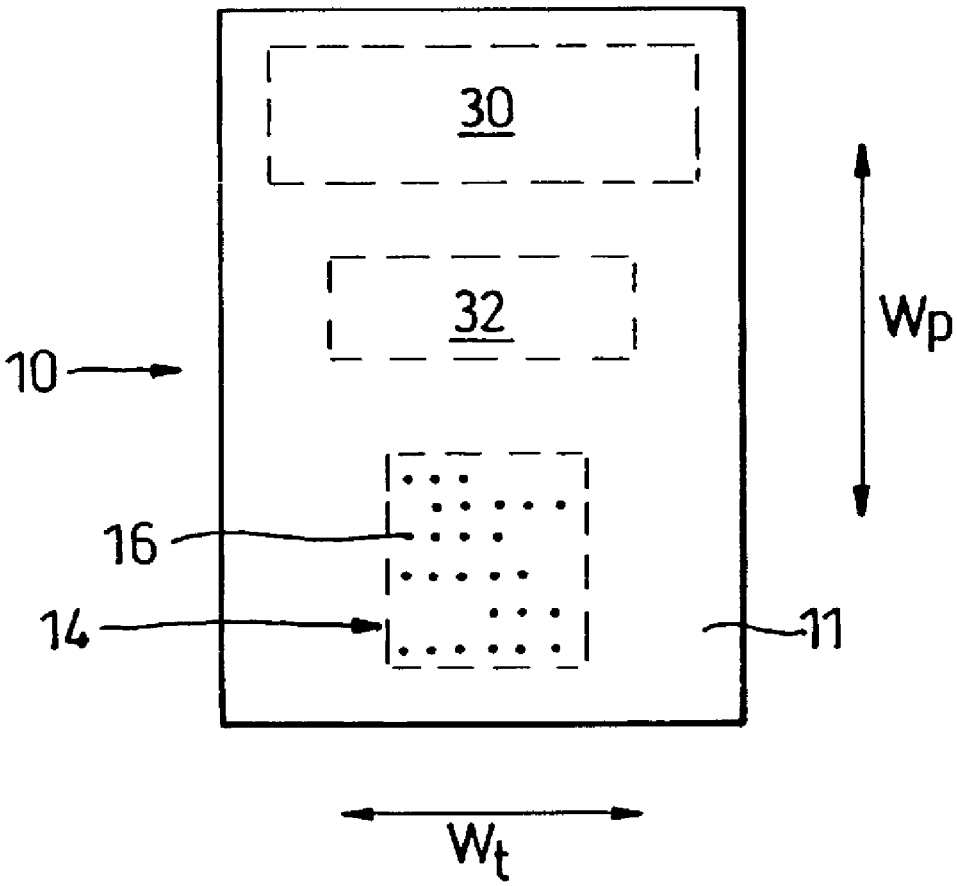

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-11 are cancelled.

* * * * *